US009032892B2

(12) United States Patent
Colquhoun

(10) Patent No.: US 9,032,892 B2
(45) Date of Patent: May 19, 2015

(54) MOORING SYSTEM AND CONNECTOR ASSEMBLY

(75) Inventor: Robin Stuart Colquhoun, Ajman (AE)

(73) Assignee: AXIS ENERGY PRODUCTS LTD., Aberdeen, Aberdeenshire (GB)

( * ) Notice: Subject to any disclaimer, the term of this patent is extended or adjusted under 35 U.S.C. 154(b) by 0 days.

(21) Appl. No.: 14/239,404

(22) PCT Filed: Aug. 17, 2012

(86) PCT No.: PCT/GB2012/052023

§ 371 (c)(1),
(2), (4) Date: Feb. 18, 2014

(87) PCT Pub. No.: WO2013/027036

PCT Pub. Date: Feb. 28, 2013

(65) Prior Publication Data

US 2014/0190385 A1 Jul. 10, 2014

(30) Foreign Application Priority Data

Aug. 19, 2011 (GB) ..... 1114291.6

(51) Int. Cl.
*B63B 21/00* (2006.01)
*B63B 21/50* (2006.01)
*B63B 27/24* (2006.01)

(52) U.S. Cl.
CPC ..... *B63B 21/00* (2013.01); *B63B 21/50* (2013.01); *B63B 27/24* (2013.01)

(58) Field of Classification Search
USPC ..... 114/230.12, 230.2, 210; 441/3–5
IPC ..... B63B 22/021,21/00, 21/50
See application file for complete search history.

(56) References Cited

U.S. PATENT DOCUMENTS

| | | | | |
|---|---|---|---|---|
| 3,979,785 | A | 9/1976 | Flory | |
| 4,154,541 | A * | 5/1979 | Tsukada | 400/124.24 |
| 4,501,113 | A * | 2/1985 | Gerber | 56/328.1 |
| 5,944,448 | A | 8/1999 | Williams | |
| 6,126,501 | A | 10/2000 | Hooper et al. | |

(Continued)

FOREIGN PATENT DOCUMENTS

| | | |
|---|---|---|
| EP | 0134596 A1 | 3/1985 |
| EP | 0656293 A1 | 6/1995 |

(Continued)

OTHER PUBLICATIONS

International Search Report for PCT/GB2012/052023 dated Dec. 4, 2012, 5 pages.

*Primary Examiner* — Stephen Avila
(74) *Attorney, Agent, or Firm* — Howard & Howard Attorneys PLLC

(57) ABSTRACT

A mooring system, and connector assembly, which in a preferred embodiment is a vessel mooring and fluid transfer system. The connector assembly has a first portion (2A) configured to be coupled to one or more mooring lines (1), and a second portion (2B) configured to be coupled to a vessel. The first and second portions are rotatable with respect to one another to permit a vessel coupling on the second portion to swivel about the mooring coupling on the first portion. In a preferred embodiment, the connector assembly comprises a guide (2E) for a conduit, which may be a fluid transfer conduit such as flexible riser (6). The invention also provides methods of use of the mooring systems described.

20 Claims, 11 Drawing Sheets

(56) References Cited

U.S. PATENT DOCUMENTS

| | | | | |
|---|---|---|---|---|
| 8,631,964 | B1 * | 1/2014 | Rael | 220/676 |
| 2009/0209154 | A1 | 8/2009 | Lunde | |

FOREIGN PATENT DOCUMENTS

| | | | |
|---|---|---|---|
| EP | 1796958 | A1 | 6/2007 |
| GB | 2 034 265 | A | 6/1980 |
| GB | 2244463 | A | 12/1991 |
| GB | 2273087 | A | 6/1994 |
| GB | 2285028 | A | 6/1995 |
| GB | 2296904 | A | 7/1996 |
| GB | 2359054 | A | 8/2001 |
| WO | WO 9611134 | A1 | 4/1996 |
| WO | WO 0051881 | A1 | 9/2000 |
| WO | WO 02/10016 | A1 | 2/2002 |
| WO | WO 03039946 | A1 | 5/2003 |
| WO | WO 2006037964 | A1 | 4/2006 |
| WO | WO 2011042535 | A1 | 4/2011 |

* cited by examiner

MOORING SYSTEM AND CONNECTOR ASSEMBLY

RELATED APPLICATIONS

This application is the National Stage of International Patent Application No. PCT/GB2012/052023, filed on Aug. 17, 2012, which claims priority to and all the advantages of Great Britain Patent Application No. GB 1114291.6, filed on Aug. 19, 2011, the content of which is incorporated herein by reference.

The present invention relates generally to mooring systems and connector assemblies for use in mooring system, and in particular to vessel mooring and fluid transfer systems and to connector assemblies for use with such systems. The invention has particular but not exclusive application to offshore oil and gas Extended Well Tests (EWTs), Early Production Systems (EPSs), Floating Production Storage and Offtake systems (FPSOs), Floating Storage and Offtake systems (FSOs) and Shuttle Tanker Loading Systems.

BACKGROUND TO THE INVENTION

Various systems have been proposed for mooring vessels such as tankers at offshore locations and transferring crude oil or other fluids between a submarine pipeline and the manifold on the deck of the vessel. Some are relatively simple but are not capable of unlimited weathervaning. Others have unlimited weathervaning capability but involve heavy and sophisticated structures and have a relatively high capital cost. Some are difficult for the vessel to pick up and disconnect. Some involve extensive traumatic invasion of the vessel hull such that the vessel cannot readily thereafter be reassigned to ordinary ocean transport duty. They also involve long and expensive drydock time.

U.S. Pat. No. 5,944,448 and GB 2,296,904 describe mooring and flowline systems which comprise a three-leg mooring and flexible riser. The flexible riser is without rotational couplings, and has a part of its length secured to a mooring pendant. There is therefore a restriction on the number of turns the vessel can make, since turning full circle will effectively twist the fluid riser in the chafe chains around one another. The systems of U.S. Pat. No. 5,944,448 and GB 2,296,904 therefore have limited weathervaning capabilities and are prone to fatigue and wear problems.

GB 2,359,054 describes a similar system in which a riser is secured to a non-swivelling node 18 and a mooring pendant. The riser comprises a single rotational coupling. As with the systems of U.S. Pat. No. 5,944,448 and GB 2,296,904, the arrangement of GB 2,359,054 is designed to cause the riser pipe to helix around the pendant chain, restricting weathervaning capabilities and inducing fatigue and wear.

Internal turret mooring systems consist of a turret and a turret casing integrated into the hull of a vessel. The two parts are connected via a bearing system which allows the turret casing to rotate around the turret. A typical design of an internal turret mooring system enables the connection of risers and associated umbilicals via a swivel stack. GB 2285028 is an example of a disconnectable turret mooring system integrated into the bow of a vessel, and WO 03/039946 is an example of a turret for the connection of a buoy to a vessel.

Internal turret systems such as those described above are in common use and are an effective means for enabling mooring and fluid transfer with full weathervaning. However, internal turret systems are expensive to implement with capital expenditure often in excess of $30m for turret fabrication and integration into the vessel.

EP 0656293 describes an alternative internal turret vessel mooring system. The document also describes a configuration in which the turret casing is mounted on a structure which extends beyond the bow of the vessel such that the turret is external to the hull (see FIG. 1 of EP 0656293). EP 1796958 is another example of an offshore vessel mooring and riser inboarding system which offers similar functionality to an internal turret but via an external assembly. In this case, the system comprises a cantilever support mounted on a bow of the vessel. This system provides a gimbal arrangement which enables movement of a turret about three mutually perpendicular axes.

External turret arrangements of a type described in EP 1796958 and EP 0656293 have the advantage that their implementation is less invasive but they still have high capital expenditure which renders them unsuitable for some installations (including short- and medium-term installations).

WO 96/11134 describes a Submerged Catenary Anchor Leg Mooring (CALM) buoy system. The CALM buoy is arranged to float below sea-level, and is anchored to the seabed by catenary anchor lines. The buoy comprises an upper and lower part, and a turntable to allow the mooring pendants to pivot with respect to the anchors. An upper hose is connected to the upper part of the buoy, and lower hoses are connected to the lower part of the buoy.

WO 2011/042535 describes another CALM mooring buoy system including a swivel. Anchor lines are connected to a lower part of the buoy beneath the swivel, and mooring lines are attached to an upper part of the buoy above the swivel. Riser terminations are provided on upper and lower parts of the buoy, with a fluid swivel arranged between the respective upper and lower risers.

The systems of WO 96/11134 and WO 2011/042535 require structural buoyancy, which is submerged in the case of WO 96/11134; the CALM buoys comprise several mechanical parts, which increases complexity and has significant implications for fabrication and installation costs.

U.S. Pat. No. 3,979,785 describes a single point mooring system comprising a mooring buoy and an anchor hub. The anchor hub is moored by catenary anchor legs, and the anchor hub is connected to the mooring buoy via a chain and swivel which allows the mooring buoy to rotate relative to the anchor hub. A cargo transfer swivel connects an underwater cargo hose to a bifurcated hose arm leading to a vessel manifold.

The system of U.S. Pat. No. 3,979,785 requires dedicated equipment and specialised assembly. It is not possible to use the system of U.S. Pat. No. 3,979,785 with a continuous riser; a fluid path swivel is necessary to provide fluid connections at the node.

WO 00/51881 discloses a single point mooring system in which a mooring line and a loading hose swivel about an anchor point on the seabed. A lump weight fastens the mooring line to the loading hose to form a point of division between a lower part and an upper part of the hose. The systems of U.S. Pat. No. 3,979,785 and WO 00/51881 are relatively complex to install. In addition, the designs limit the number of chains that can be brought directly to the vessel bow, which may compromise the robustness of the moorings.

There is a need in the market for a simple, robust and economical system which lends itself to use in the context of short term FSO installations such as those serving Extended Well Test export systems (EWTs) as well as in the context of medium term installations supporting Early Production Systems (EPSs) and in the context of longer term installations supporting Floating Production Storage and Offtake systems (FPSOs) and Floating Storage and Offtake systems (FSOs) and Shuttle Tanker Loading Systems.

It is amongst the objects of the invention to provide a mooring system and/or a connector assembly which obviates at least mitigates one or more deficiencies of previously proposed mooring systems, and in which mariners can have confidence. One aim of the invention is provide a mooring system and/or a connector assembly that has a good weathervaning capability. Another aim of the invention is to provide a mooring system and/or a connector assembly which facilitates quick and efficient disconnect and reconnect operations; is easy to install and recover; is easy and efficient to use; and/or has relatively low capital and operating costs.

Further aims and objects of the invention will become apparent from reading the following description.

SUMMARY OF THE INVENTION

According to a first aspect of the invention, there is provided a connector assembly for a vessel mooring system, the connector assembly comprising:

a first portion configured to be coupled to one or more mooring lines;

a second portion configured to be coupled to a vessel;

wherein the first and second portions are rotatable with respect to one another to permit a vessel coupling on the second portion to swivel about the mooring coupling on the first portion.

Preferably, the connector assembly comprises a guide for a conduit, which may be a fluid transfer conduit such as flexible riser. Alternatively or in addition, the conduit may comprise electrical power cables or electrical or fibre optic instrumentation and control cables. More preferably, the connector assembly comprises an aperture for receiving a conduit. The aperture may be oriented substantially along a longitudinal axis of the connector assembly, and may be concentric with the connector assembly. The connector assembly may therefore comprise a hollow core which defines the aperture. In a preferred embodiment the connector assembly is substantially cylindrical and aperture is a hollow core of the cylinder.

The first portion may comprise a sleeve and/or the second portion may comprise a sleeve. Preferably, the first and second portions comprise inner and outer sleeves which rotate with respect to one another.

The first portion may comprise an outer cylindrical sleeve, and/or may be made of steel. The first portion preferably comprises a plurality of mooring couplings for a plurality of mooring lines, which couplings may be padeyes or other couplings suitable for the connection of mooring lines formed from chain, wire rope, polymer rope, or a hybrid of these.

The second portion may comprise an inner cylindrical bush, and/or may be made from steel. The second portion may be disposed at least partially within the first portion, and may be rotatable with respect to the first portion.

The second portion may comprise at least one vessel coupling, and preferably comprises a pair of vessel couplings for connection to a pair of upper lines or a bridle of a single upper line. Preferably the second portion comprises a pair of lever arms or torque bars, which may comprise the at least one vessel coupling.

The connector assembly may comprise bearings between the first and second portions, which may comprise water-lubricated bearings, and preferably are radial and/or axial plastic journal bearings. Alternatively the bearings may be composite bearings or ball race bearings.

Preferably, at least one of the upper or lower lips of the aperture are faired, curved or broadened to assist in the passage and/or guiding of a conduit. Preferably, the shape of the at least one of the upper or lower lips is selected to match the minimum bend radius of the conduit.

According to a second aspect of the invention, there is provided a vessel mooring system comprising:

a vessel; one or more mooring lines terminating in seabed anchors; and a connector assembly;

wherein the connector assembly comprises a first portion coupled to the one or more mooring lines and a second portion coupled to an upper line connected to the vessel;

wherein the first and second portions are rotatable with respect to one another to permit the vessel and upper line to rotate with respect to the mooring lines.

The invention therefore allows the vessel to weathervane while the mooring lines to which it is connected are substantially geo-stationary.

Preferably, the connector assembly is located at an intermediate depth between the sea surface and the seabed.

The mooring lines and/or upper line may comprise chain, wire rope, polymer rope, or a hybrid of these. The anchors may comprise drag embedment anchors, piled anchors and/or gravity anchors, depending on the local geotechnical and metocean conditions.

The mooring lines below the connector assembly may be fitted with subsea buoys to improve their configuration characteristics and to reduce the pickup load when the mooring is being installed to the vessel. This may be particularly relevant in cases where the mooring lines are chains.

The system may comprise a pair of upper lines, or may comprise a bridle and a single upper line. The upper line(s) may terminate in chafe chains, which may pass through a panama fairlead(s) of the vessel. The upper line(s) may be secured by chainstopper(s) on the focsle deck.

Preferably, the system comprises a fluid transfer conduit, which may be a flexible riser. The fluid transfer conduit may be received in an aperture or guide of the connector assembly. The aperture or guide may be a hollow core of the connector assembly and therefore the fluid transfer conduit may pass through the connector assembly.

The system may comprise a fluid swivel, which may be an inline fluid swivel, and the fluid transfer conduit may be connected to the swivel.

The system may further comprise a connection and disconnection package, which may be a Quick Connect and Dis-Connect (QCDC) assembly, and which may be located at or near the prow of the vessel. The swivel may be fixed to a lower part of the connection and disconnection package, and an upper part of the connection and disconnection package may be connected to a vessel manifold. Preferably, the upper part of the connection and disconnection package is connected to the vessel manifold by rigid piping, and/or more preferably the upper part of the connection and disconnection package is connected to the vessel manifold via an emergency shutdown valve.

The vessel mooring system may further comprise an extended support means for the conduit which functions to separate at least an upper portion of the conduit from a part of the vessel and/or a mooring line. The extended support means may comprise a cantilever structure, and/or may comprise an elongated chute for the conduit. Preferably the extended support means is isolated from the mooring loads on the connector assembly.

The system may comprise a plurality of conduits (which may be flexible risers), and may comprise a multi-path swivel. The multi-path fluid swivel may be of the toroidal type or another suitable type depending on the fluid pressures involved.

Where the system comprises electrical power cables or electrical or fibre optic instrumentation and control cables, it may further comprise a slipring box mounted above or in place of the fluid swivel.

Embodiments of the second aspect of the invention may include one or more features of the first aspect of the invention or its embodiments, or vice versa.

According to a third aspect of the invention, there is provided an offshore fluid transfer system comprising:

a vessel;

a fluid transfer conduit for transferring fluid to the vessel;

and a fluid conduit guide;

wherein the fluid transfer conduit passes through the fluid conduit guide;

and wherein the fluid transfer conduit guide comprises a swivel which permits components of the guide to rotate around the fluid transfer conduit.

Preferably the guide comprises a connector assembly comprising a first portion configured to be coupled to one or more mooring lines; a second portion configured to be coupled to a vessel; wherein the first and second portions are rotatable with respect to one another to permit a vessel coupling on the second portion to swivel about the mooring coupling on the first portion.

Embodiments of the third aspect of the invention may include one or more features of the first or second aspects of the invention or their embodiments, or vice versa.

According to a fourth aspect of the invention, there is provided a method of slipping a mooring of a vessel, the method comprising:

providing a system comprising a vessel; a fluid transfer conduit for transferring fluid to the vessel; and a mooring system comprising a fluid conduit guide, a connection and disconnection package, and an abandonment buoy; wherein the fluid transfer conduit passes through the fluid conduit guide, and wherein the connection and disconnection package comprises a lower part connected to the fluid transfer conduit and an upper part connected to the vessel;

closing valves in the connection and disconnection package;

releasing the lower part of the connection and disconnection package;

supporting the fluid conduit guide using the abandonment buoy; and allowing the fluid transfer conduit and lower part of the connection and disconnection package to descend relative to the guide.

Preferably, the connection and disconnection package is a Quick Connect and Dis-Connect (QCDC) assembly, which may be located at or near the prow of the vessel.

Preferably the fluid transfer conduit guide comprises a swivel which permits components of the guide to rotate around the fluid transfer conduit, and more preferably is a connector assembly according to the first aspect of the invention and/or its preferred embodiments.

The method may comprise controlling the descent of the fluid transfer conduit using one or more tugger lines. In one embodiment, the descent is controlled by a double reeved tugger line passing through a block on the lower part of the connection and disconnection package.

The method may comprise disconnecting the riser(s) and allowing them to free fall. The method may comprise allowing the riser or risers until restrained by a strop attached to the mooring chain. The method may comprise subsequently disconnecting the mooring allowing it to free fall to the sea to be supported by an abandonment buoy. This release may be initiated by a single action on the vessel.

The lower part of the connection and disconnection package may have a pennant and marker buoy, which may facilitate subsequent recovery and re-reeving of the tugger line upon return of the vessel.

The abandonment buoy may be designed to float on the sea surface or below the surface. In the latter case, the mooring system may comprise an additional pennant and marker buoy, which may be located so as to minimise the risk of entanglement with a riser head pennant and marker buoy.

Embodiments of the fourth aspect of the invention may include one or more features of any of the first to third aspects of the invention or their embodiments, or vice versa.

According to a fifth aspect of the invention, there is provided a method of mooring a vessel, the method comprising:

providing a vessel; a mooring system comprising an abandonment buoy and a fluid conduit guide; and a fluid transfer conduit for transferring fluid to the vessel;

wherein the mooring system is supported by the abandonment buoy, and the fluid transfer conduit comprises a lower part of a connection and disconnection package attached to an upper end and the fluid transfer conduit passes through the fluid conduit guide;

raising the fluid transfer conduit and lower part of the connection and disconnection package to ascend relative to the fluid conduit guide;

attaching the lower part of the connection and disconnection package to an upper part of the connection and disconnection package located on the vessel;

opening valves in the connection and disconnection package.

Embodiments of the fifth aspect of the invention may include one or more features of any of the first to third aspects of the invention or their embodiments, or vice versa.

According to a sixth aspect of the invention, there is provided a method of transferring a fluid to an offshore vessel, the method comprising the use of a system or method according to any of the first to third aspects of the invention or their preferred embodiments.

The method may comprise transferring the fluid to a vessel and performing an extended well test on the vessel. Alternatively or in addition, the method may comprise transferring a production fluid to the vessel for storage and/or transport. The vessel may comprise an Early Production Systems (EPS), a Floating Production Storage and Offtake system (FPSO), a Floating Storage and Offtake system (FSO) and/or a Shuttle Tanker Loading System.

Embodiments of the sixth aspect of the invention may include one or more features of any of the first to fifth aspects of the invention or their embodiments, or vice versa.

According to a seventh aspect of the invention there is provided a connector assembly for an offshore energy generator mooring system, the connector assembly comprising:

a first portion configured to be coupled to one or more mooring lines;

a second portion configured to be coupled to an offshore energy generator;

wherein the first and second portions are rotatable with respect to one another to permit an offshore energy generator coupling on the second portion to swivel about the mooring coupling on the first portion;

and wherein the connector assembly comprises a guide for a conduit.

Embodiments of the seventh aspect of the invention may include one or more features of any of the first to sixth aspects of the invention or their embodiments, or vice versa.

According to an eighth aspect of the invention there is provided a mooring system for an offshore energy generator device, the mooring system comprising an offshore energy generator device, one or more mooring lines terminating in seabed anchors; a connector assembly; and a conduit;

wherein the connector assembly comprises a first portion coupled to the one or more mooring lines and a second portion coupled to an upper line connected to the offshore energy generator device;

wherein the first and second portions are rotatable with respect to one another to permit the offshore energy generator device and upper line to rotate with respect to the mooring lines;

and wherein the connector assembly provides a guide for the conduit.

Preferably the conduit is an electrical power transmission cable. Alternatively or in addition the conduit may comprise electrical or fibre optic instrumentation or control cables.

The offshore energy generator device may comprise a wave generator, or may comprise a tidal generator. Alternatively the offshore energy generator device may comprise a wind turbine generator.

Embodiments of the eighth aspect of the invention may include one or more features of any of the first to seventh aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
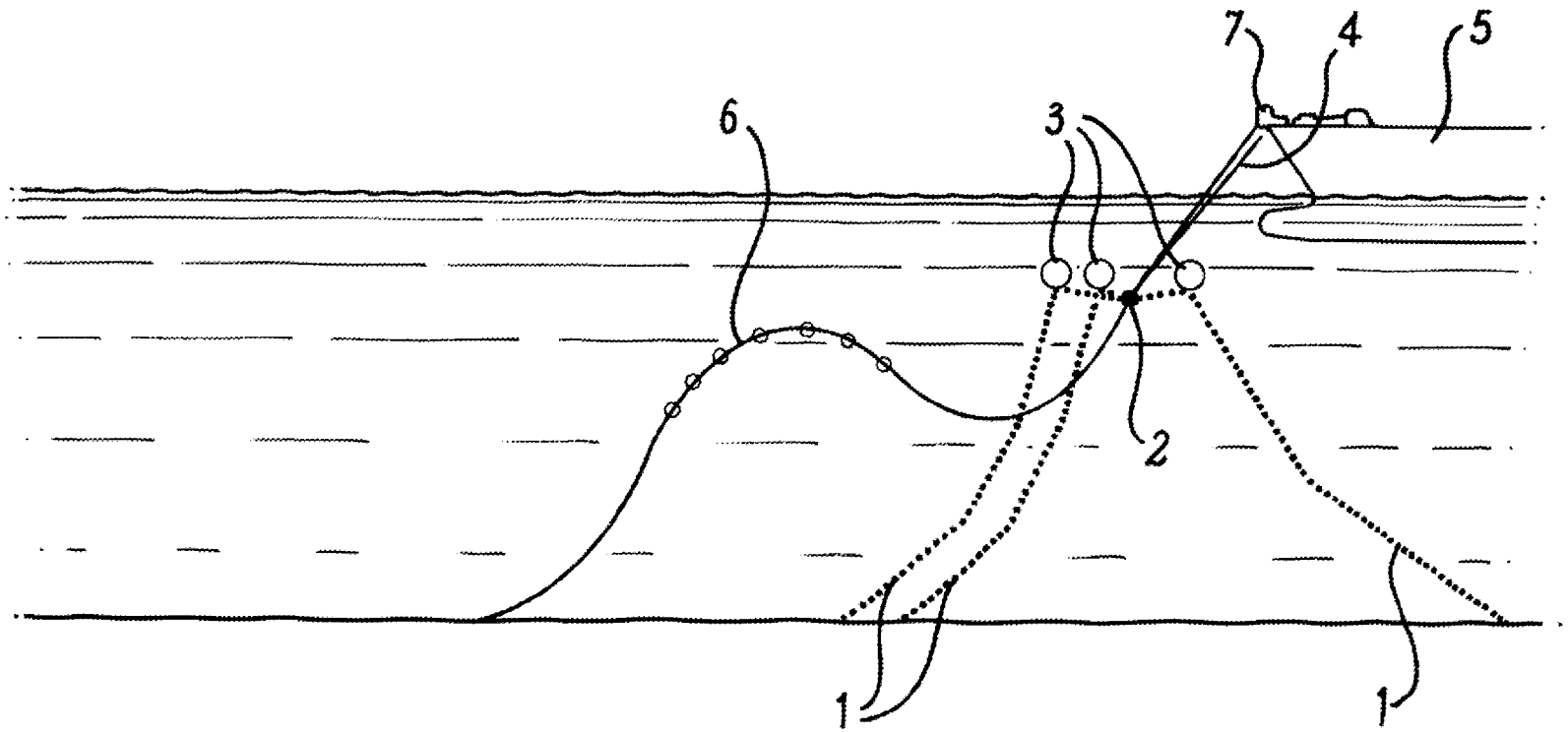
FIG. 1 shows schematically an operational mooring system in accordance with an embodiment of the invention in elevation.

Turning firstly to FIG. 1, there is shown a group of catenary mooring lines 1 rising from seabed anchors to a hollow swivel connector assembly 2 with each line being partially supported by a subsea buoy 3. The hollow swivel connector assembly is in turn attached by the upper mooring line 4 to the bow of the vessel 5. There is shown a flexible fluid transfer riser 6 in Wave configuration ascending from the seabed to the hollow swivel connector assembly 2 and thence to a Quick Connect and Dis-Connect (QCDC) hangoff 7 close to the vessel prow.

Figure 2:
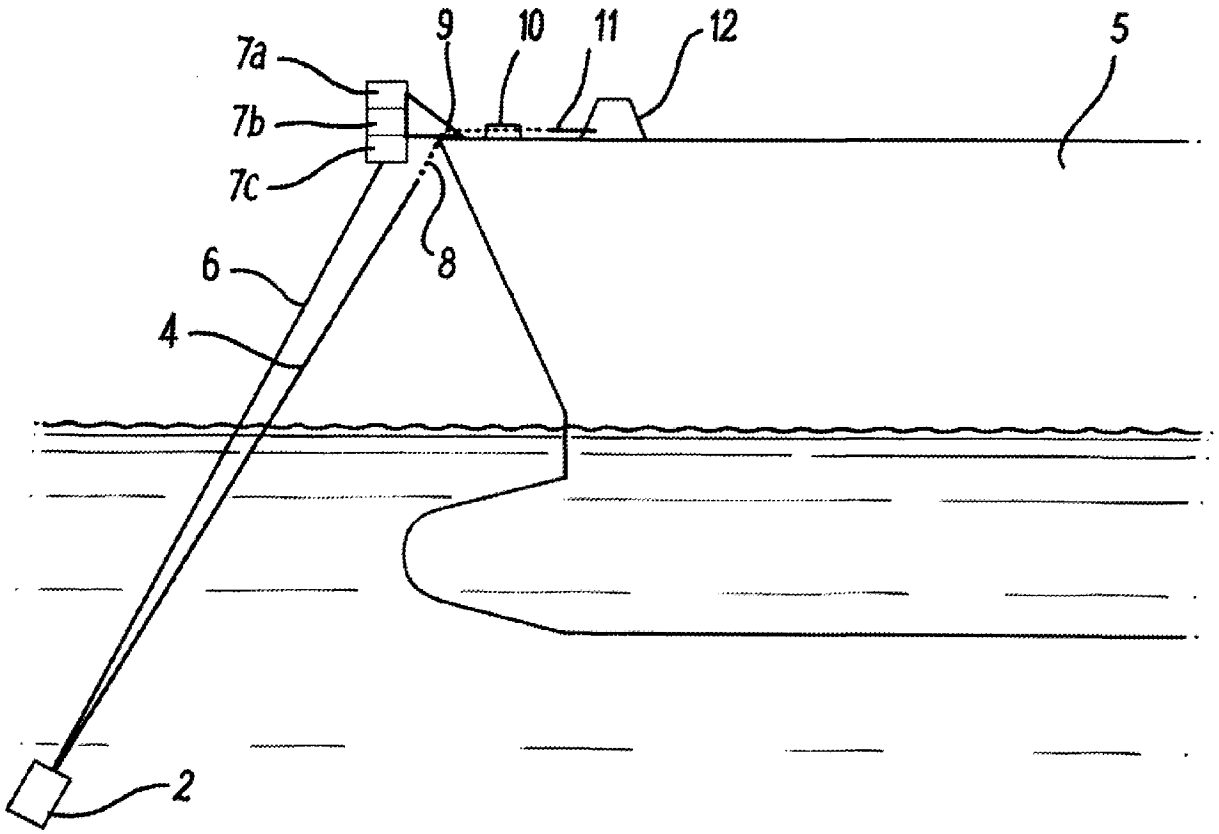
FIG. 2 is an enlarged view of an upper part of the system of FIG. 1 in elevation.

Turning next to FIG. 2, there is shown in greater detail the upper mooring line 4 attached to a chafe chain 8 which passes through the panama fairlead 9 and bowstopper 10 to connect to the pickup line 11 deployed from the pickup winch 12. The QCDC is shown in greater detail divided into its components, viz. the upper QCDC assembly 7*a*, which is securely fixed to the vessel, the lower QCDC assembly 7*b*, which in the operational condition is held in the jaws of the upper QCDC assembly 7*a*, and the in-line fluid swivel 7*c*, which is fixed to the lower QCDC assembly 7*b* above it and to the head of the riser 6 below it. The upper QCDC assembly 7*a* and lower QCDC assembly 7*b* include hydraulically actuated anti-spill ball valves.

Figure 3:
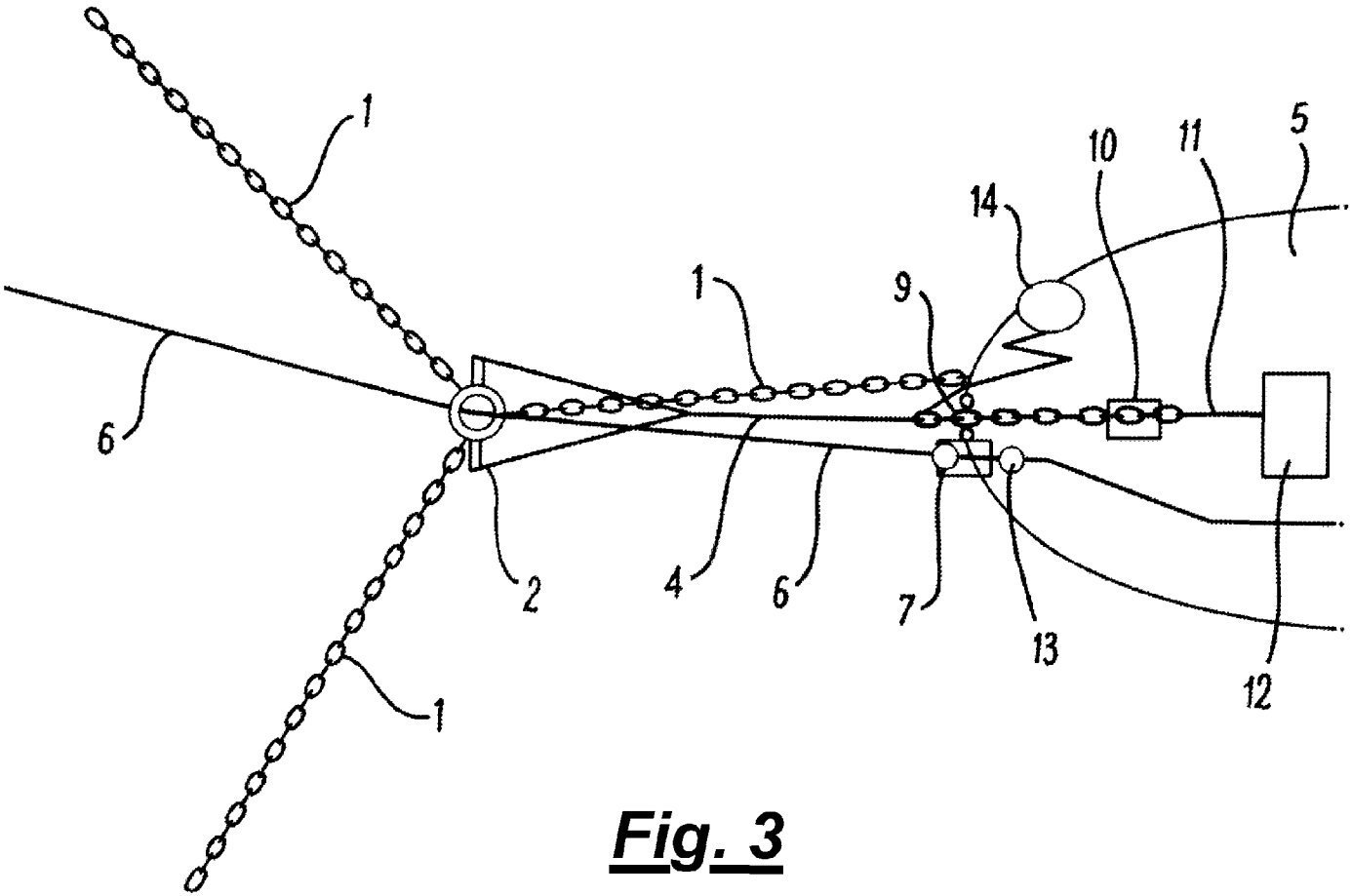
FIG. 3 is a plan view of the system of FIG. 1.

Turning to FIG. 3, there is shown a plan view of the aforementioned features. In addition there is shown the mandatory Emergency Shut-In Valve (ESV). Located on the focsle deck of the vessel during normal operation is an abandonment buoy 14 attached to the mooring pickup line at a point outboard of the panama fairlead.

Figure 4:
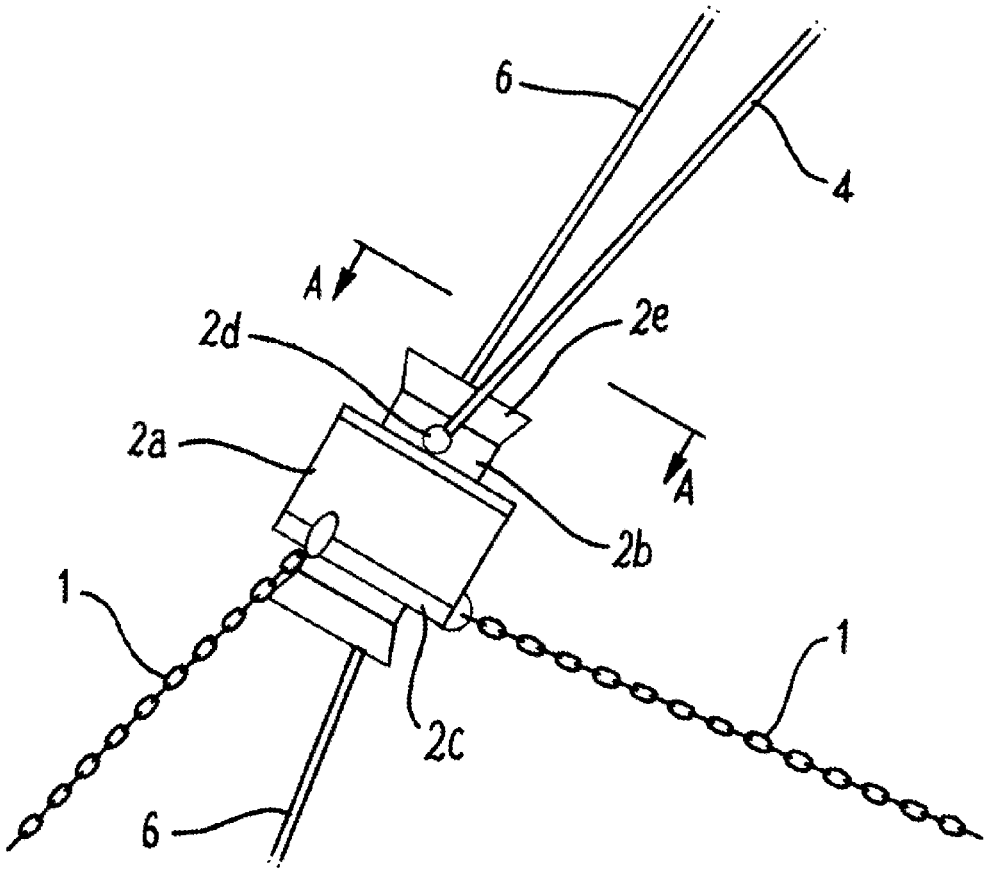
FIG. 4 is a view of a hollow swivel connector assembly in accordance with an embodiment of the invention in elevation.
Figure 5:
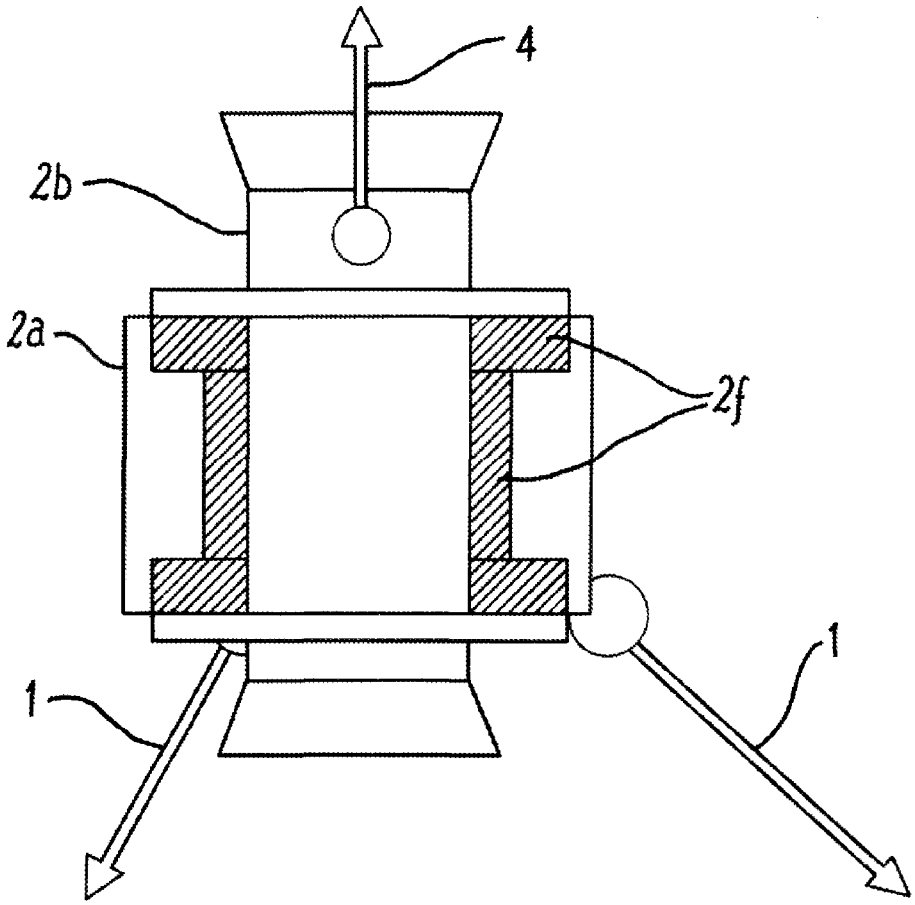
FIG. 5 is a sagittal section through the hollow swivel connector assembly of FIG. 4.
Figure 6:
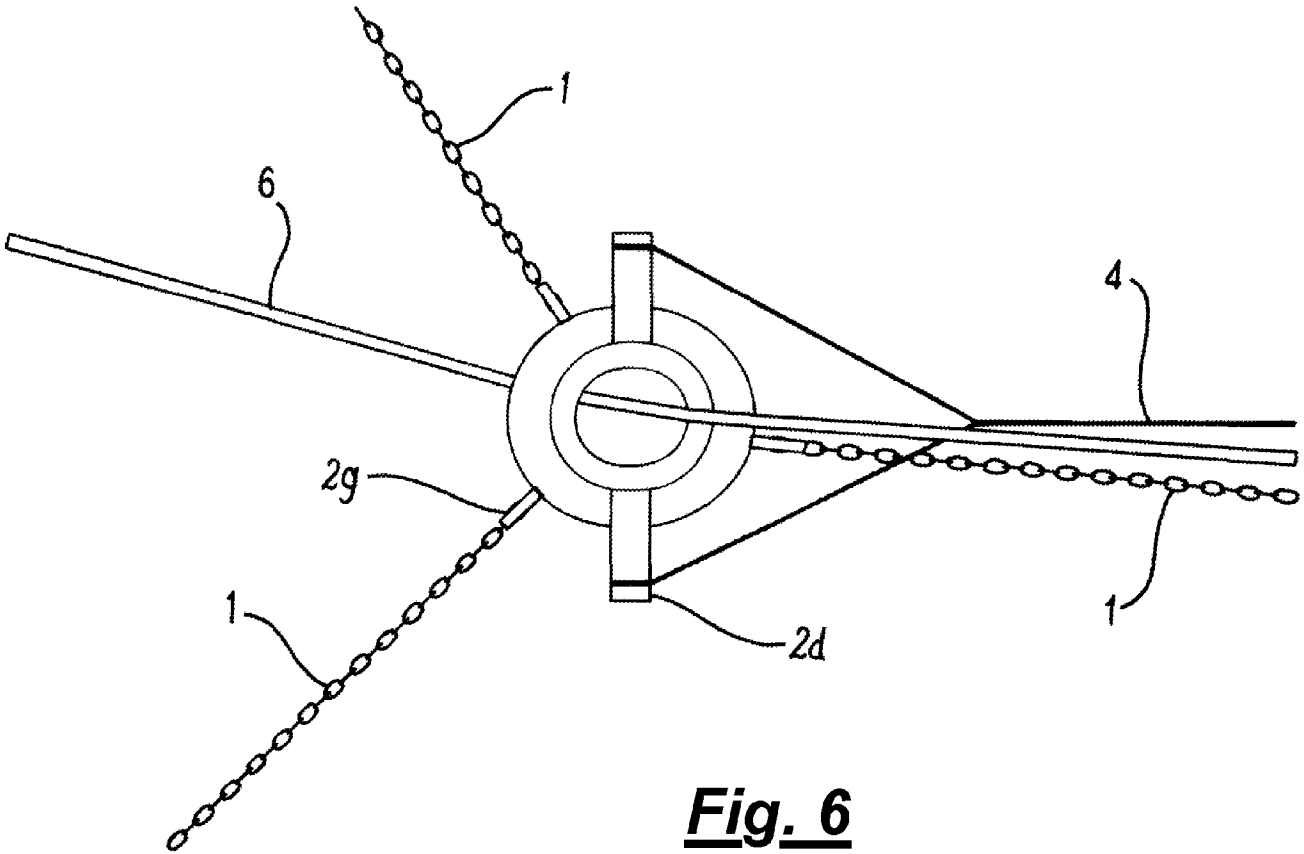
FIG. 6 is a section normal to the axis of the hollow swivel connector assembly of FIG. 4.

Turning now to FIGS. 4 to 6, there is shown the hollow swivel connector assembly in outside elevation and sagittal sections respectively. The outer cylinder 2*a* embraces the inner cylinder 2*b*, while end plates 2*c* retain the journal bearings within and assist in the transfer of axial load. The bridle of the upper mooring line 4 is attached to the torque bars 2*d* (as also visible in FIG. 3). FIG. 5 shows the water lubricated plastic journal bearings 2*f* between the inner and outer cylinders. The bearing may for example be an annular bearing, of the type supplied by Thordon Bearings Inc, although other bearing types may be used.

In FIG. 6, the aforementioned features of the hollow swivel connector assembly are shown from a different viewpoint and in addition the torque bars 2*d* are more clearly indicated. Although the water lubricated plastic journal bearings 2*f* have a low coefficient of friction when moving against machined steel, the connection of the upper mooring line bridle via the torque bars 2*d* gives added assurance that breakout friction will be overcome as the vessel weathervanes with the changing azimuth of the environmental load.

The hollow swivel connector assembly is located at an intermediate depth between the sea surface and the seabed and consists of (a) an outer cylindrical sleeve, which may be made of steel, carrying padeyes for the connection of at least three mooring lines radiating therefrom, which mooring lines may be made of chain or of wire rope or of polymer rope or a hybrid of these and which terminate in seabed anchors, which may be drag embedment anchors or piled anchors or gravity anchors depending on the local geotechnical and metocean conditions, and (b) an inner cylindrical bush, which may be made of steel, which is located within the outer sleeve and can rotate within the sleeve with the aid of water-lubricated radial and axial plastic journal bearings and to which are affixed close to its upper end a pair of lever arms or torque bars connected to a pair of upper lines or to the bridle of a single line terminating in chafe chains passing through the panama fairlead(s) and secured by bowstopper(s) on the focsle deck. This arrangement permits the inner cylinder to rotate with the weathervaning vessel while the outer cylinder connected to the mooring lines remains sensibly geo-stationary.

The fluid transfer riser ascending from the seabed passes through the hollow core of the inner cylinder, whose upper and lower lips are faired to match the Minimum Bending Radius (MBR) of the riser pipe, and proceeds thence to an in-line fluid swivel fixed to the lower part of a Quick Connect and Dis-Connect (QCDC) assembly mounted at and just forward of and/or just adjacent to the prow of the vessel. Flexible or rigid piping connects the upper QCDC assembly to the ship's manifold via an Emergency Shutdown Valve (ESV). There may be more than one fluid riser, in which case the fluid swivel will need to be a multi-path swivel of the toroidal or other suitable type depending on the fluid pressures involved. In addition to or instead of fluid risers there may be electrical power cables or electrical or fibre optic instrumentation and control cables, in which case there will be a need for a slipring box mounted above or in place of the fluid swivel.

Redundancy of that part of the mooring system below the hollow swivel connector assembly may be provided by increasing the number of mooring lines. Redundancy of that part of the mooring system above the hollow swivel connector assembly may be achieved by providing two upper lines, each line being attached to the hollow swivel connector assembly by its own bridle to the torque bars.

The mooring lines below the hollow swivel connector assembly may be fitted with subsea buoys to improve the chain configuration and to reduce the pick up load when installing the mooring to the vessel. This may be particularly relevant in cases where the mooring lines are chains.

When the vessel is to slip her mooring, either to take her cargo to port or in response to a severe storm warning, the QCDC valves are shut and the QCDC jaws are opened thus dropping the head of the riser with the fluid swivel and lower QCDC assembly into the water, the riser sliding down through the core of the hollow swivel connector assembly until it rests on top of it. This descent is controlled, for example, by a double reeved tugger line passing through a block on the lower QCDC assembly. When the descent is complete, the tugger line end is released and the tugger line is run out of the block and recovered inboard. The lower QCDC assembly has a pennant and marker buoy attached for subsequent recovery and re-reeving of the tugger line upon return of the vessel.

The abandonment buoy is now unlashed, the bowstopper is opened, and the pickup line is paid out by the pickup winch until the abandonment buoy has been pulled overboard and takes the weight of the mooring system. The pickup line, which is now slack, is immediately disconnected and the vessel drifts back off the mooring before sailing away. The abandonment buoy may be designed to float on the sea surface or below the surface. In the latter case an additional pennant and marker buoy are needed and are located so as to minimise the risk of entanglement with the riser head pennant and marker.

In an alternative embodiment, which may be preferred in some implementations, the disconnect method comprises first disconnecting the riser(s) and allowing them to free fall until restrained by a strop attached to the mooring chain. Subsequently the mooring is disconnected allowing it to free fall to the sea to be supported by an abandonment buoy. This release may be initiated by a single action on the vessel.

Figure 7:
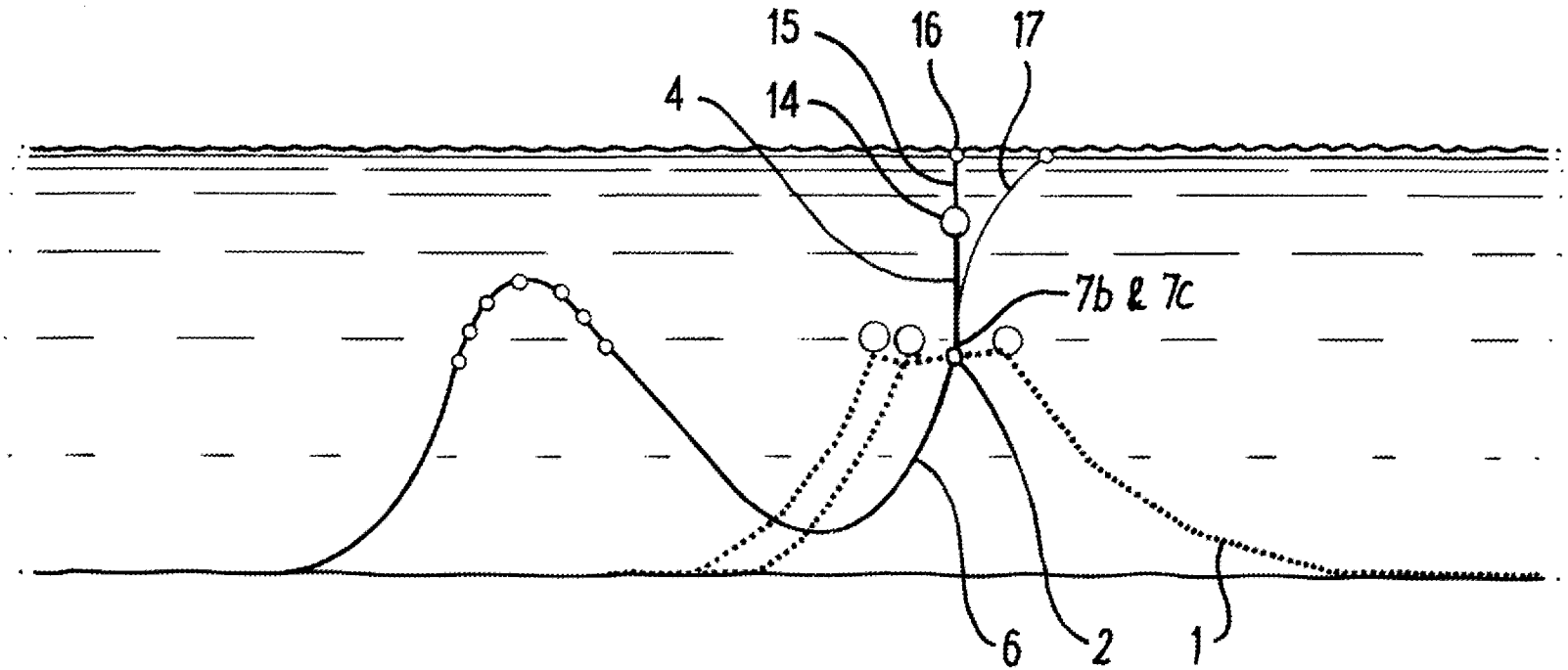
FIG. 7 shows schematically an abandoned mooring system in accordance with an embodiment of the invention in elevation.

Turning to FIG. 7, there is shown a general arrangement in elevation of the system after abandonment and vessel departure. There is shown an abandonment buoy 14 supporting the abandoned mooring system and a pennant 15 and marker buoy 16 to aid in its subsequent recovery. There is shown the lower QCDC assembly 7*b* and fluid swivel 7*c* which have descended with the riser head until they rest on the hollow swivel connector assembly 2 after the upper part of the fluid riser 6 has descended through the hollow swivel connector assembly and now hangs below it. There is also shown a pennant 17 and marker buoy arrangement attached to the lower QCDC assembly 7*b* and having a length intended to minimise the risk of entanglement with the abandonment buoy pennant 15.

The mooring pickup procedure on return of the vessel to the field is the reverse of the foregoing with the difference that the pennants have to be grappled from the focsle or recovered with the aid of a team deployed from the vessel in a rubber inflatable boat (RIB).

In the foregoing embodiment, the fluid transfer riser 6 is coupled to a Quick Connect and Disconnect (QCDC) hang-off mounted on a short cantilever frame close to the bow. It will be appreciated that other attachment arrangements the mooring chains and riser may be used within the scope of the invention, and embodiments are shown in FIGS. 8 to 11.

Figure 8:
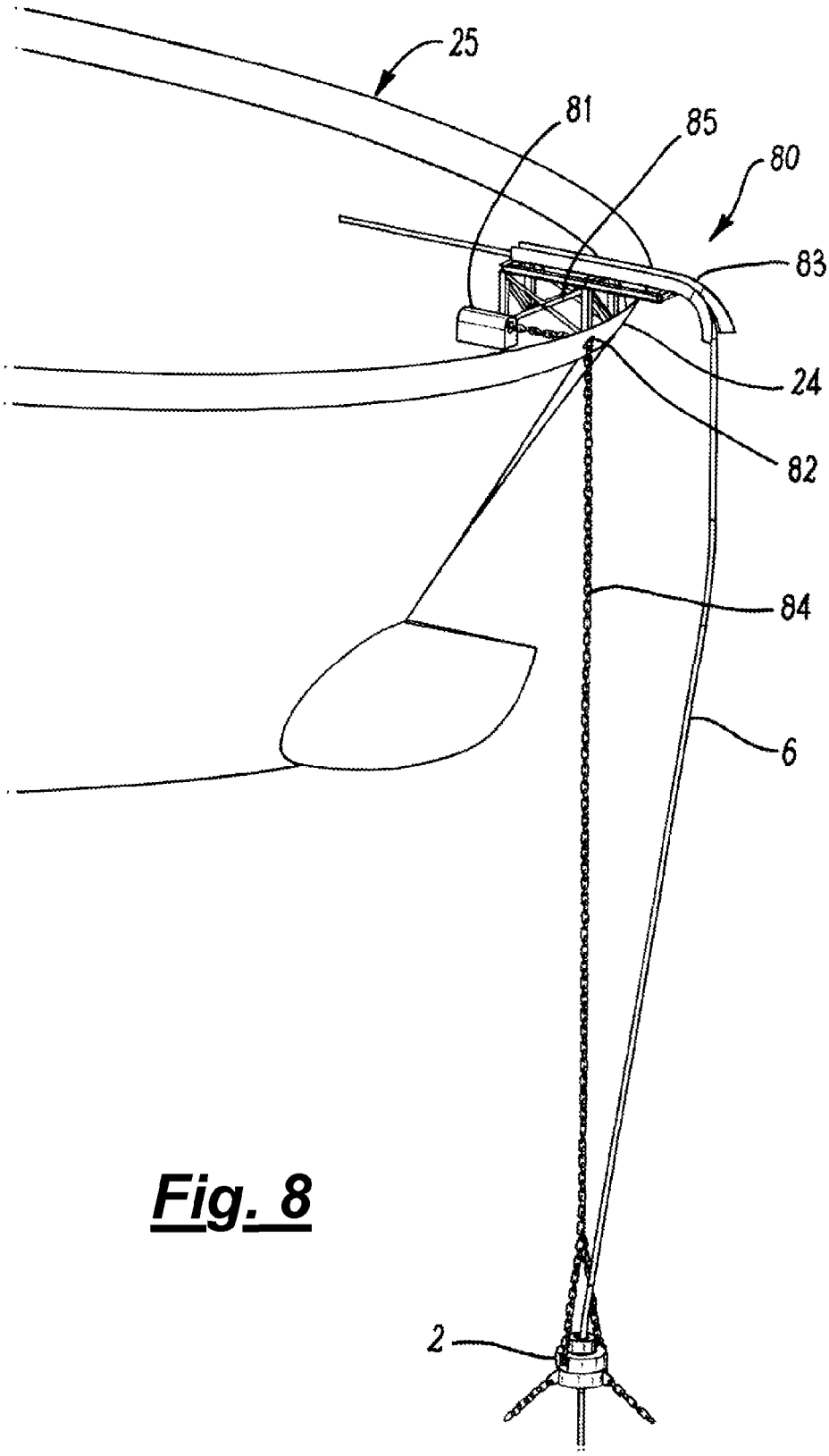
FIG. 8 is an isometric view of an attachment arrangement according to an alternative embodiment of the invention comprising an extended support for a fluid transfer riser.

Referring to FIG. 8, there is shown an isometric view of an attachment assembly according to an alternative embodiment of the invention, generally depicted at 80. This embodiment comprises a single chain stopper 81 from which a chafe chain 84 passes through a fairlead 82 at the bow 24 of the vessel 25 to the connector assembly 2. The fluid transfer riser 6 passes through the connector assembly 2 to an extended support means in the form of elongated chute 83. The elongated chute 83 is mounted on a frame 85 at the bow of the vessel and extends from the bow 24. The fluid transfer riser 6 passes over the chute 83 such that the upper position of the riser 6 is separated from the fairlead 82 and the hull of the vessel 25. The chute 83 therefore provides a cantilever structure which prevents the riser 6 from clashing with the vessel and provides separation between the path of the riser 6 and the chafe chain 84.

Figure 9:
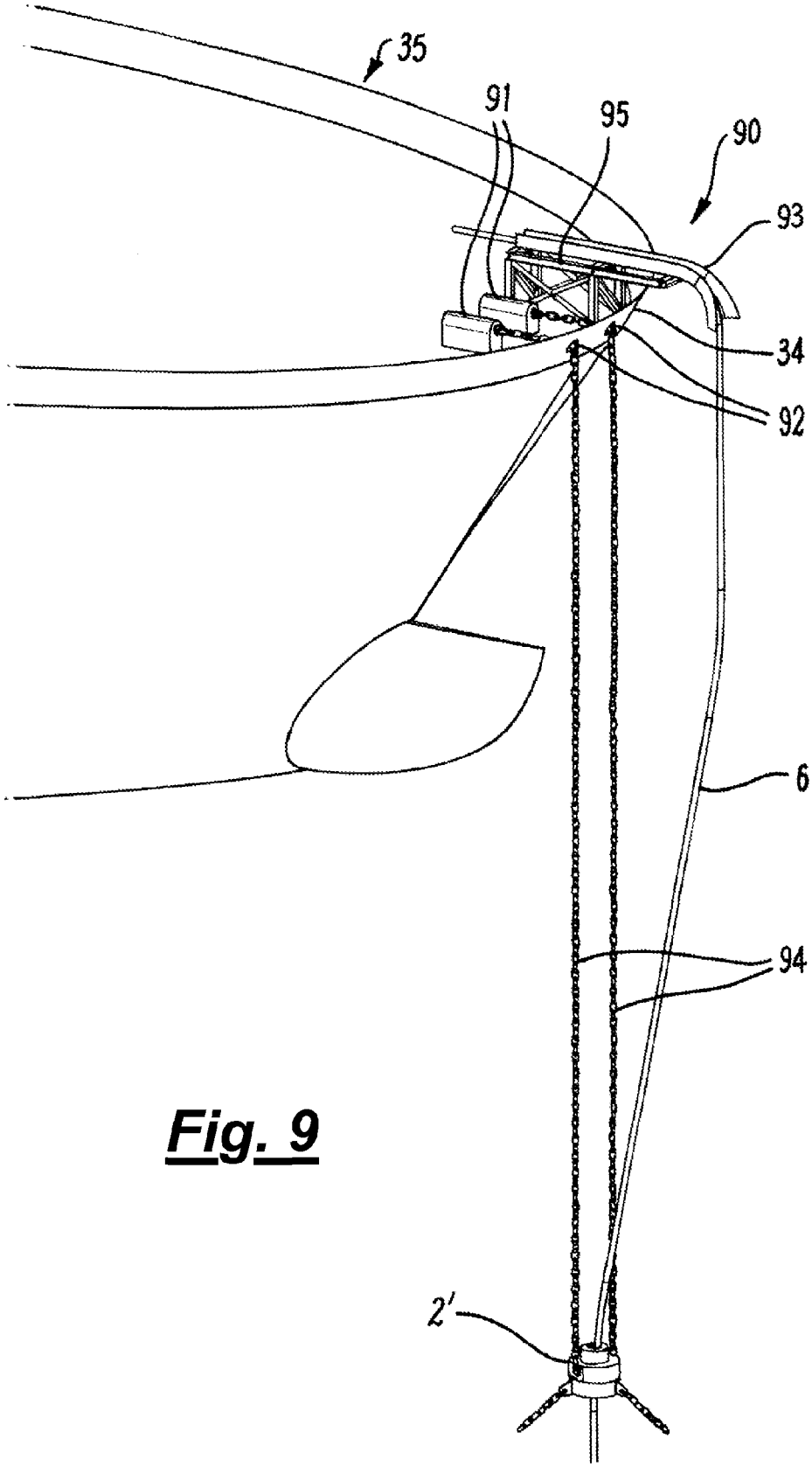
FIG. 9 is an isometric view of an attachment arrangement according to a further alternative embodiment of the invention comprising an extended support for a fluid transfer riser with a pair of chain stops.

FIG. 9 is an isometric view of an alternative embodiment of the invention, comprising an attachment assembly generally shown at 90, which is similar to the assembly 80 and will be understood from FIG. 8 and the accompanying description. The assembly 90 differs from that of 80 in that the connector assembly 2' is attached to the vessel by twin chain stoppers 91. The pair of chafe chains 94 pass through a pair of fairleads 92 at the bow 34 of the vessel 35, and as with the assembly 80, the riser 6 passes over an elongated chute 93 on a frame 95. The chute 93 provides an extended support means which separates the riser from the bow 34 of the vessel 35 and the path of the chafe chains 94.

Figure 10:
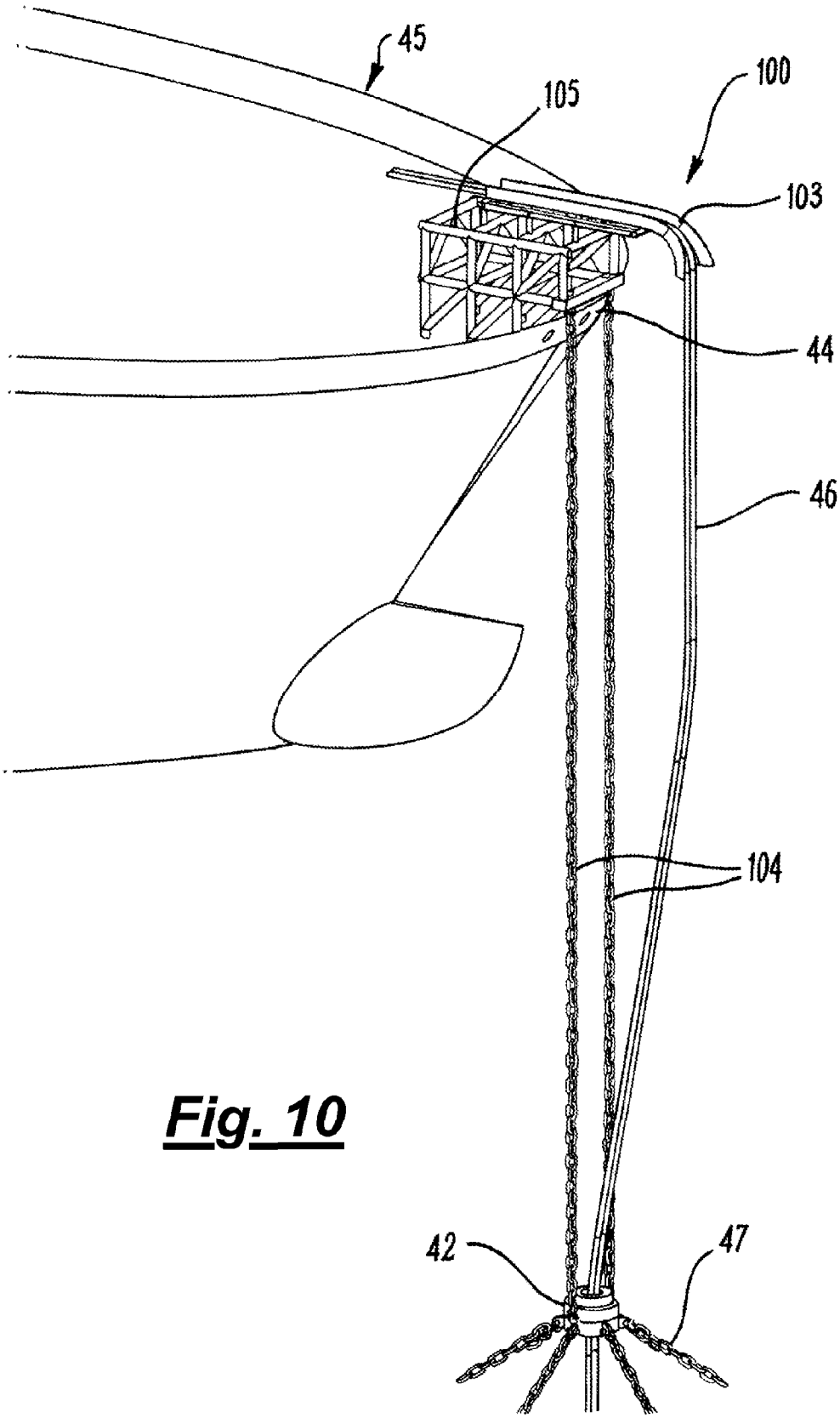
FIG. 10 is an isometric view of an attachment arrangement according to a further alternative embodiment of the invention comprising a cantilever frame and an extended support for a fluid transfer riser.

FIG. 10 is an isometric view of a further alternative embodiment of the invention, generally shown at 100. Again, this embodiment will be understood from the embodiment of FIGS. 8 and 9 and the accompanying description. However, the assembly 100 comprises a cantilever frame 105 which extends over the focsle deck equipment on the vessel 45. The cantilever frame 105 provides a short cantilever for hang-off of the chafe chains 104 coupled to the connector assembly 42. The cantilever frame 105 also supports an elongated chute 103 which extends over the frame 105 and provides a longer cantilever for the riser 46 which separates the riser position from the bow 44 of the vessel 45 and the chafe chains 104. It will be noted that in this embodiment the riser 46 comprises a pair of riser conduits, and the connector assembly 42 comprises multiple (in this case five) catenary mooring lines 47 to seabed anchors.

Figure 11:
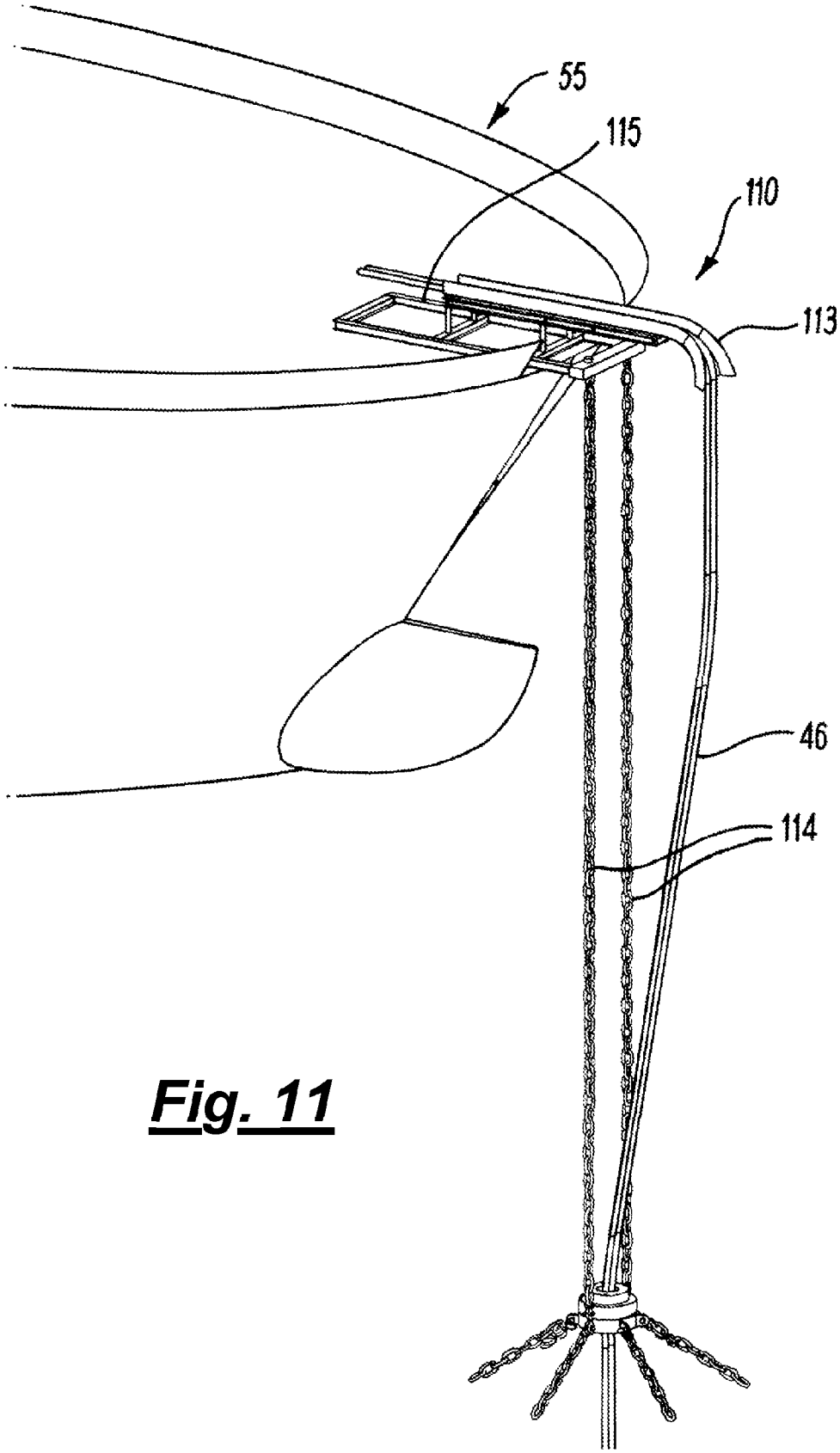
FIG. 11 is an isometric view of an attachment arrangement according to a further alternative embodiment of the invention comprising a cantilever frame and an extended support for a fluid transfer riser.

A further alternative attachment assembly is shown in FIG. 11, generally depicted at 110. The attachment assembly 110 is similar to the assembly 100 and will be understood from FIG. 10 and the accompanying description. However, in this embodiment a cantilever frame 115 extends around focsle equipment (as opposed to the assembly 100 in which the cantilever frame 105 is built up and extends over the focsle deck equipment). The cantilever frame 115 provides chain hang-off for a pair of chafe chains 114 and supports an extended riser cantilever chute 113 which separates the position of the riser 46 from the hull of the vessel 55 and the chafe chains 114.

The connector assembly of the described embodiments of the invention is configured such that the riser is isolated from the node of the mooring system (i.e. the connector assembly). This facilitates the provision of an extended support means, such as the elongated chute described with reference to FIGS. 8 to 11, to be provided for the riser. The extended support means for the riser is not required to withstand or support the full mooring loads of the vessel, as the connector isolates the riser from the mooring loads. The upper portion of the flexible riser can be readily separated from the bow of the vessel and/or the chafe chains, for example by a simple elongated chute as illustrated in the embodiments of FIGS. 8 to 11, which need only support the loads associated with the flexible riser itself.

The invention provides a connector assembly for a vessel mooring system. The connector assembly has a first portion configured to be coupled to one or more mooring lines, and a second portion configured to be coupled to a vessel. The first and second portions are rotatable with respect to one another to permit a vessel coupling on the second portion to swivel about the mooring coupling on the first portion. In a preferred embodiment, the connector assembly comprises a guide for a conduit, which may be a fluid transfer conduit such as flexible riser. The invention also provides a vessel mooring system comprising the connector assembly and method of use.

The present invention relates to a hollow swivel connector assembly for connecting a vessel to a mooring array in an offshore environment, to a vessel attached to such a connector assembly, to an offshore vessel mooring system containing such a connector assembly, and to one or more fluid transfer risers or cables ascending from the seabed and passing loosely through the connector assembly and thence to the focsle of the vessel via a fluid swivel and/or slipring box.

The present invention creates an improved arrangement for mooring a tanker at an offshore location and transferring oil or other fluids between a submarine pipeline and the tanker in a manner which enables the tanker to weathervane unrestrictedly in response to changing weather and tidal flow directions. The arrangement eliminates the need for any significant invasion of the tanker hull or deck so that a vessel of opportunity can be employed and can be returned to ordinary ocean trading at the end of the project period. Embodiments of the invention permit rapid connection of the tanker to the mooring and riser and rapid disconnection. The system can be configured using components which are standard marine or offshore oil and gas industry items which are readily available for purchase or rental in the market. The novel custom-built hollow swivel connector assembly joins the upper and lower parts of the mooring line array and the fluid transfer riser ascends through the connector assembly on its way from the seabed to the prow of the vessel. By providing a connector assembly which functions as a mooring swivel at the node, which is designed in such a way as to allow the riser(s) to pass through its centre, provides the mooring system with unlimited weathervaning capability.

A preferred embodiment features a geo-stationary outer cylinder connected to the main mooring lines and an inner cylinder connected by one or more upper mooring lines to the vessel with which it is free to weathervane. The two cylinders are separated by water-lubricated plastic journal bearings of a type already widely used in naval, maritime, and offshore industry applications. The system may be used with a plurality of risers.

The foregoing embodiments relate to vessel mooring systems, but it will be appreciated that the present invention also has application to the mooring of other types of offshore asset including drilling rigs and platforms and offshore energy generator devices. In one aspect of the invention the connector assembly is used in to moor an offshore wave generator device, where a power transmission conduit is guided through the connector assembly.

Various modifications may be made within the scope of the invention as herein intended, and embodiments of the invention may include combinations of features other than those expressly described herein.

The invention claimed is:

1. A connector assembly for a vessel mooring system, the connector assembly comprising:

a first portion comprising a mooring coupling, the first portion configured to be coupled to one or more mooring lines;

a second portion comprising a vessel coupling, the second portion configured to be coupled to a vessel, wherein the first and second portions are rotatable with respect to one another to permit the vessel coupling on the second portion to swivel about the mooring coupling on the first portion and wherein the second portion is disposed at least partially within the first portion;

a fluid transfer conduit; and a guide for the fluid transfer conduit, the guide comprising an aperture in the second portion through which the fluid transfer conduit is received, wherein the aperture has upper and lower lips which are curved to assist in the passage of the fluid transfer conduit through the aperture, the shape of the upper and lower lips being selected to correspond to a minimum bend radius of the fluid transfer conduit.

2. The connector assembly according to claim 1, wherein the second portion is disposed substantially within the first portion.

3. The connector assembly according to claim 1, wherein the fluid transfer conduit is a flexible riser.

4. The connector assembly according to claim 1, wherein in use the guide is configured to isolate the fluid transfer conduit from mooring loads on the connector assembly.

5. The connector assembly according to claim 1, wherein the fluid transfer conduit is movable in an axial direction relative to the connector assembly.

6. The connector assembly according to claim 1, wherein the fluid transfer conduit is rotationally moveable in relation to the connector assembly.

7. The connector assembly according to claim 1, wherein the aperture comprises an insert having a shape selected to correspond to the minimum bend radius of the fluid transfer conduit.

8. The connector assembly according to claim 1, wherein the first and second portions comprise inner and outer sleeves which are rotatable with respect to one another.

9. The connector assembly according to claim 1, wherein the first portion comprises a plurality of mooring couplings for a plurality of mooring lines.

10. The connector assembly according to claim 1, wherein the second portion comprises an inner cylindrical bush.

11. The connector assembly according to claim 1, wherein the second portion comprises a pair of lever arms which provide the at least one vessel coupling.

12. The connector assembly according to claim 1, wherein the aperture is in the centre of the second portion.

13. The connector assembly according to claim 1, further comprising bearings between the first and second portions.

14. The connector assembly according to claim 13, wherein the bearings are water-lubricated bearings.

15. The connector assembly according to claim 1, wherein in use the mooring lines below the connector assembly are provided with subsea buoys.

16. The connector assembly according to claim 1, further comprising a connection and disconnection package.

17. The connector assembly according to claim 1, further comprising an extended support means for the fluid transfer conduit which functions to separate at least an upper portion of the fluid transfer conduit from a part of the one or more mooring lines.

18. The connector assembly according to claim 17, wherein the extended support means comprises a cantilever structure.

19. The connector assembly according to claim 17, wherein the extended support means comprises an elongated chute for the fluid transfer conduit.

20. The connector assembly according to claim 17, wherein the extended support means is isolated from the mooring loads on the connector assembly.

* * * * *

UNITED STATES PATENT AND TRADEMARK OFFICE

CERTIFICATE OF CORRECTION

PATENT NO. : 9,032,892 B2
APPLICATION NO. : 14/239404
DATED : May 19, 2015
INVENTOR(S) : Robin Stuart Colquhoun It is certified that error appears in the above-identified patent and that said Letters Patent is hereby corrected as shown below:

On the title page, item 73 Assignee, after "Energy", please delete "Products" and replace with
-- Projects --

Signed and Sealed this
Fifth Day of January, 2016

Michelle K. Lee

Michelle K. Lee
*Director of the United States Patent and Trademark Office*